United States Patent [19]

Kolpin

[11] Patent Number: 4,900,982

[45] Date of Patent: Feb. 13, 1990

[54] ELECTRON GUN DESIGN

[75] Inventor: Hans J. Kolpin, White Lake, Canada

[73] Assignee: Atomic Energy of Canada Limited-Energie Atomique Du Canada Comitee, Ottawa, Canada

[21] Appl. No.: 285,801

[22] Filed: Dec. 16, 1988

[30] Foreign Application Priority Data

Jan. 7, 1988 [CA] Canada ..... 555997

[51] Int. Cl.[4] ..... H01J 3/02; H01J 3/38

[52] U.S. Cl. ..... 313/452; 313/146; 313/237; 313/238

[58] Field of Search ..... 313/452, 237, 238, 256, 313/146

[56] References Cited

U.S. PATENT DOCUMENTS

| | | | |
|---|---|---|---|
| 3,581,357 | 6/1971 | Oess | 29/25.16 |
| 3,777,210 | 12/1973 | Spalding | 313/256 |
| 4,057,746 | 11/1977 | Dumonte | 313/237 |
| 4,621,213 | 11/1986 | Rand | 313/237 |

*Primary Examiner*—Kenneth Wieder

*Attorney, Agent, or Firm*—Brumbaugh, Graves, Donohue & Raymond

[57] ABSTRACT

An electron gun which is rugged, provides good thermal decoupling of the cathode, permits precise alignment of the electrodes to be achieved easily and allows geometric changes to be carried out with ease is described. In the cathode assembly three set screws and a split ring of insulating material are used to secure the cathode. Alignment is achieved by suitably adjusting the set screws and because contact can be limited to the three set screws thermal coupling is reduced. Similarly a Whenelt electrode is secured and aligned by a further group of set screws. Finally, the anode is secured to replaceable stand-offs by means of screws passing through oversized holes in an anode plate. The oversized holes permit easy alignment and the use of stand-offs permits the spacing between anode and cathode to be changed as desired by replacing the stand-offs.

17 Claims, 3 Drawing Sheets

ELECTRON GUN DESIGN

This invention relates to an electron gun particularly but not exclusively useful in industrial accelerators.

BACKGROUND OF THE INVENTION

An electron gun is a device which emits free electrons, shapes and accelerates them to form an electron beam. The physics design of an electron gun is usually done with the aid of modern computer codes which will predict the size and divergence of the beam for a given geometry and current. Examples of several different types of electron guns are the Rogowski gun, the telefocus gun and the Pierce gun.

Hot cathodes are the most frequently used emitters although many other materials emit free electrons. Several types of hot cathodes are commonly used in electron gun designs such as tantalum wire or disc emitters, tungsten wire or disc emitters, thoriated carburized tungsten wire emitters, oxide cathodes, dispenser cathodes and lanthanum hexaboride (LAB 6) cathodes.

Electron guns which are currently available suffer from one or more of the following disadvantages. They are not very rugged and, consequently, cannot be used advantageously in an industrial environment where continuous use over a long period is necessary. Precise alignment of the electrodes, particularly important for high power electron guns, is not easily achieved. Replacement of the cathode when required is complicated. Geometric changes cannot be achieved easily. Thermal decoupling of the cathode is not sufficient to prevent heater damage. The beam current transmitted from the electron gun is not easily controllable.

OBJECTS AND SUMMARY OF THE INVENTION

It is an object of the present invention to obviate or mitigate one or more of the above mentioned disadvantages.

Broadly, the invention is a modified diode space charge limited gun having a Whenelt electrode which is used to control transmitted electron gun current.

More particularly, according to a first broad aspect, the invention provides a cathode assembly for mounting in an electron gun, comprising a metal support member having a first portion for securing the support member to a cathode assembly support within the gun and having a second portion which is generally cylindrical, a plurality of set screws spaced around the periphery of the second portion and extending radially through the thickness of the second portion, a split ring of solid insulating material having an outer diameter slightly less than the inner diameter of the first portion of the metal support member and being received within the first portion, a metal cylindrical holder having an outer diameter less than the inner diameter of the split ring and being received within the split ring to define with respect to the split ring a cylindrical space, a metal cathode tube carrying at its one end a cathode and heater and having at its other end a portion which is received snugly within the cylindrical space, the cathode tube having a bore through which extend heater leads, whereby axial alignment of the cathode can be adjusted by means of the set screws.

According to this aspect, alignment of the cathode can easily be achieved. Moreover, especially when a slight clearance is provided between the split ring and the second portion of the metal support member, the only contact points for conducting away heat from the cathode tube are at the set screws and, if there are only a few of these (typically four) heat loss is reduced dramatically. This is extremely important for maintaining a long cathode life.

According to a second broad aspect, the invention provides a Whenelt electrode assembly for mounting in an electron gun, comprising a Whenelt electrode and a cylindrical metal housing having at one end means for securing the housing to a cathode assembly and having at the other end securing means for securing the Whenelt electrode across the bore of the housing, the securing means comprising a plurality of set screws spaced around the periphery of the housing and extending radially through the housing to engage complementary groove means in the periphery of the Whenelt electrode, the Whenelt electrode having an outer diameter less than the diameter of the housing bore whereby axial alignment of the Whenelt electrode can be adjusted by means of the set screws.

According to this aspect, alignment of the Whenelt electrode can easily be achieved. Additionally, as with the cathode assembly design, this aspect of the invention provides thermal decoupling between the Whenelt and the metal housing as the only conduction is via the set screws which are typically no more than three in number. In use heat radiated from the cathode and stored in the Whenelt is conducted away through the gun housing much more slowly than in prior art designs. This means that there is more available stored heat in the Whenelt for reflection back to the cathode thereby reducing the brightness required by the cathode heater.

This aspect of the invention also allows the Whenelt to be replaced by differently shaped Whenelts according to the desired beam shape.

According to a third aspect of the present invention, there is provided an anode assembly for mounting in an electron gun, comprising metal mounting means having a plurality of spaced parallel post portions attachable at a first end to a vacuum flange of the electron gun and having at a second end means for mounting an anode so as to extend in a transverse plane between the post portions, the means for mounting being arranged to hold the anode at a selected one of a plurality of different portions in the transverse place whereby axial alignment of the anode can be adjusted.

As with the other two aspects, this aspect provides a simple aligning arrangement, this time for the anode. Also, by mounting the anode on stand-off posts or rods, the spacing between the anode and cathode can be changed easily simply by using longer or shorter stand-offs and this determines the space charge limiting of the electron gun.

Typically, the means for mounting the anode to the post portions comprises screws threadably received in holes axially extending from the second end of the post portions and passing through oversized holes in an anode holder to which the anode is secured, the oversized holes permitting the adjustment of the lateral alignment, the screws having heads securing the anode holder at the selected position.

The anode is typically made of molybdenum and the holder of stainless steel. The molybdenum anode reduces iron and chromium ion back bombardment from the holder to the cathode which would "poison" the emissive cathode and shorten its life. The anode insert can easily be replaced as desired by a shaped anode as the anode is held in place typically by a few screws.

DESCRIPTION OF THE PREFERRED EMBODIMENT

Figure 1:
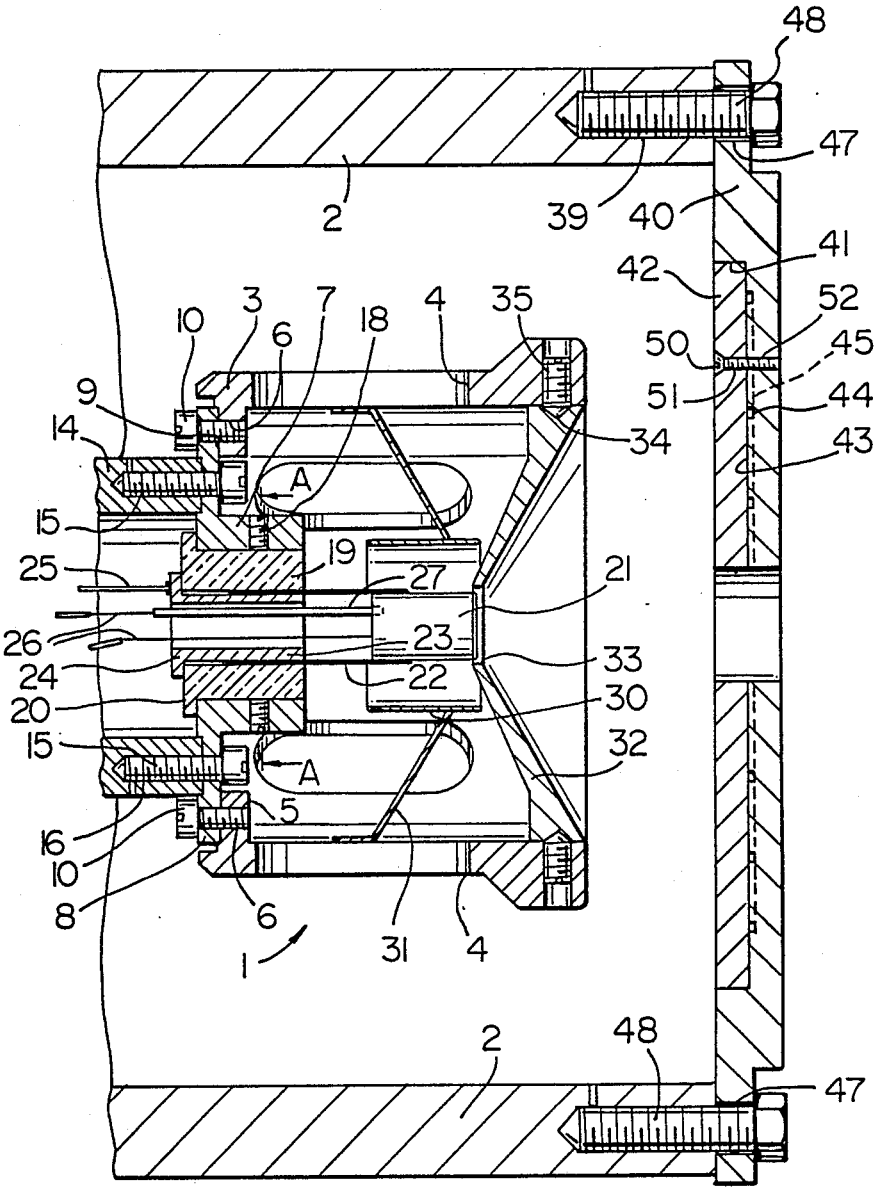
FIG. 1 is a fragmentary longitudinal sectional view of an electron gun particularly illustrating details of the anode, cathode and Whenelt electrode.

With reference firstly to FIG. 1, this shows an assembly of a cathode mounting system and a Whenelt electrode, the assembly being generally referenced 1 and being positioned concentrically within an anode mounting system comprising three 120° spaced posts 2.

Assembly 1 includes a generally cylindrical housing 3 made of stainless steel and provided with elongate through holes or slots 4 spaced at regular intervals around the periphery of the housing 3. One end of housing 3 is provided with an inwardly directed angular flange 5 provided with threaded through holes 6 spaced at regular intervals around the flange 5.

A stainless steel cylindrical support member 7 having a diameter approximately half of the diameter of housing 3 and a length approximately one third of the length of housing 3 is disposed concentrically within housing 3 adjacent the end of housing 3 from which flange 5 projects. For the purpose of securing member 7 to housing 2, cylindrical member 7 has an outwardly directed annular flange 8 provided with through holes 9 aligned with the threaded holes 6 of flange 5. Screws 10 received through holes 9 and threadably engaging holes 6 secure flanges 5 and 8 together.

Flange 8 is provided with a further set of through holes 13 located radially inwardly of holes 9 for the purpose of mounting assembly 1 to a cylindrical cathode assembly support 14 by means of screws 15 which pass through the holes 13 and threadably engage threaded holes 16 which extend axially inwardly from one end of cylindrical support 14.

Figure 2:
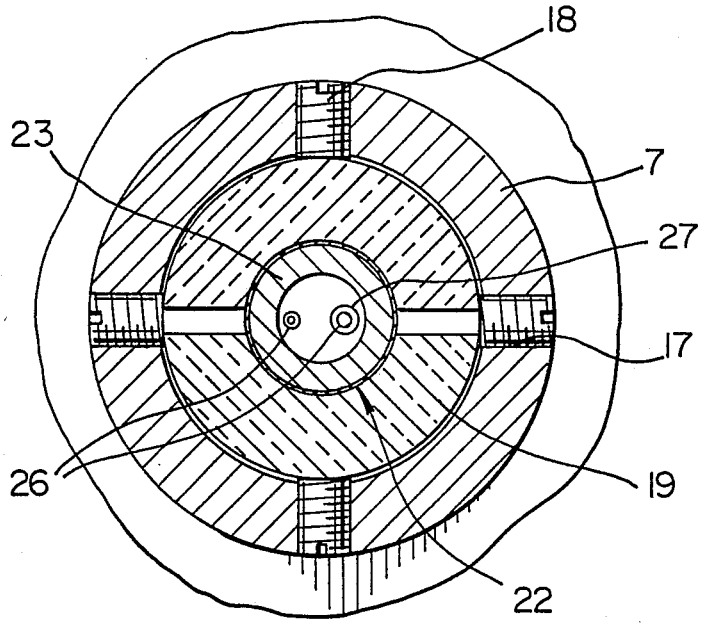
FIG. 2 is a cross-sectional view of a cathode clamping arrangement taken on line A—A of FIG. 1.

With particular reference to FIG. 2 in conjunction with FIG. 1, cylindrical support member 7 is provided with four equally spaced threaded holes 17 each receiving a set screw 18.

A ring 19 of insulating material, for example a machinable ceramic material known by the trade name MACOR or alumina and which is, as can be seen in FIG. 2, made in two separate halves, is received within cylindrical support member 7. An outwardly extending flange 20 abuts an end of member 7. The outer diameter of split ring 19 is slightly less than the inner diameter of support member 7 thereby providing a small clearance which permits the central axis of the split ring 19 to be adjusted relative to the central axis of support member 7 as desired by adjusting set screws 18. The clearance which is of the approximate order of 0.200 mm is shown somewhat exaggerated in FIG. 2 for clarity.

A dispenser cathode 21 is commercially available mounted on a 19 mm long 50/50 molybdenum-rhenium tube 22 having a wall thickness of 0.025 mm. The wall thickness is shown exaggerated in FIG. 2 for clarity. The end of the tube 22 remote from cathode 21 is received within split ring 19 and supported by means of a stainless steel cylindrical holder 23 which is received inside tube 22 and sandwiches tube 22 against split ring 19. The pressure of the four set screws 18 clamps split ring 19 against tube 22 holding it rigidly in place against holder 23. Holder 23 has a radially outwardly directed flange 24 at one end which abuts an end of split ring 19. A cathode tantalum wire lead 25 is spot welded to flange 24. Cathode heater leads 26 pass through the bore of holder 23 and one of the leads is held at a negative potential with respect to the cathode and, consequently, is provided with a surrounding alumina insulating tube 27.

A heat shield 30 made of 50/50 molybdenum-rhenium and formed as a tube 0.127 mm thick surrounds cathode 21. Heat shield 30 is mounted to housing 3 by three equally angularly spaced spot welded support legs 31. An end of heat shield 30 is closely spaced with respect to one surface of a Whenelt electrode 32 which is made of molybdenum and is machined to a good finish. Whenelt electrode 32 is dish-shaped and has a central aperture 33 slightly bigger than the diameter of the cathode 21 such that cathode 21 can be received within aperture 33. The wall thickness of Whenelt electrode 32 is least adjacent aperture 33 and increases towards its periphery where a continuous notch 34 extends around the periphery. Whenelt electrode 32 is dimensioned to be received within housing 3 such that there is some clearance therebetween. Electrode 32 is located at the end of housing 3 remote from flange 4 and is held in place by means of set screws 35 threadably received in holes 36 which extend radially through housing 3 at 120° intervals, the ends of the set screws 35 being received in the notches 34: The central axis of electrode 32 can be adjusted relative to the central axis of housing 3 as desired by adjusting set screws 35.

Figure 3:
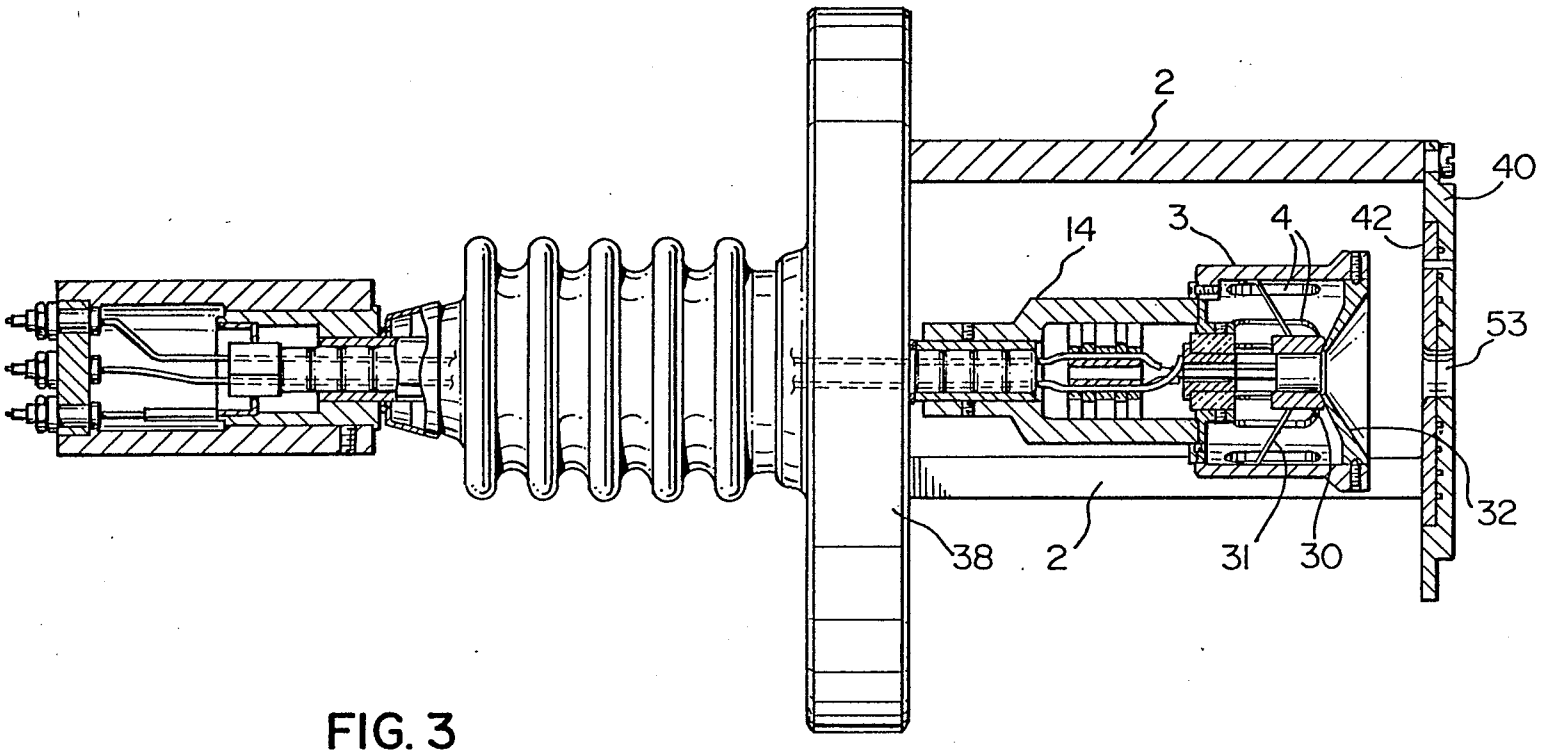
FIG. 3 is a longitudinal sectional view of the complete electron gun.

Turning now to the anode, as indicated initially an anode mounting system comprises three 120° spaced posts 2. As can be seen in FIG. 3, posts 2 are mounted at one end to a CONFLAT (trade mark) vacuum flange 38 of the gun. The other end portions of the posts extend just beyond housing 3 and Whenelt electrode 32 and are each provided at that end with an axially extending threaded hole 39.

An anode holder 40 is made of a circular stainless steel plate having a circular recess 41 receiving an anode 42 made of molybdenum and machines to a good finish. The lower surface 42 of the recess is provided with circular grooves 44 interconnected by straight grooves 45 across surface 43. The grooves in the surface 43 are vacuum pumping ports where the straight grooves are connecting to the curved grooves. In this way gasses trapped or produced in the space between anode insert and surface 43 are pumped away. Without these slots a virtual vacuum leak would be created. A virtual vacuum leak is a condition when gasses are trapped between two surfaces and slowly leak into the work area.

Three axial through holes 47 are provided at 120° intervals around the periphery of anode holder 40 and these are aligned with holes 39. Screws 48 pass through the holes 47 and threadably engage holes 39 to secure anode holder to posts 2. Holes 47 are deliberately made oversized with respect to the step of the screws 48 so that the anode plate and anode can be adjusted laterally before tightening the screws.

Anode 42 is secured to holder 40 by means of screws 50 receiver in countersunk holes 51 in the anode and threadably engaging threaded holes 52 in holder 40. A central aperture 53 aligned with cathode 21 and Whenelt aperture 33 is provided in anode 42 and anode holder 40.

It will be appreciated that the electron gun of the present invention is designed so that each element (cathode, Whenelt electrode and anode) can easily be aligned to each other thus obtaining precise beam alignment. Specifically, the cathode is positioned by the set screws 18, the Whenelt electrode is positioned by set screws 35 and the anode is positioned by manually aligning it prior to fully tightening screws 48. Space charge limiting of the electron gun can be easily changed by modifying the anode standoff rods 2.

Thermal decoupling of the cathode is important for the life of the heater. The aim is to drive the heater at the lowest brightness possible. Thermal decoupling by mounting the cathode on a thin-walled tube is standard practice. However, the thermal decoupling is further enhanced in the present invention by the low thermo conductivity of split ring 19 and the Whenelt electrode 32 which acts more as a thermal reflector in the immediate cathode region rather than a heatsink. This is achieved by having only three contact points to the main gun assembly.

As described above, the anode assembly contains a molybdenum anode insert 42, thus reducing iron and chromium ion back bombardment. The Whenelt electrode is electrically isolated from the cathode by the macor split ring 19. The Whenelt electrode can therefore be biased and the gun output current can be controlled in a triode-like fashion, without the need of a separate control grid.

A Whenelt electrode is a non-intercepting beam forming and focussing electrode which operates at a negative potential with respect to the cathode. It was originally used in electron sources for microscopes. Such electron guns use very small diameter cathodes. The spotsize of the beam is normally extremely small. The Whenelt electrode is used to focus the beam. Using these small cathodes, the electron gun current output can usually be cut off by applying approximately −300 Volts to the Whenelt electrode.

However when large cathodes (several mm diameter) are used the current output of the gun can no longer easily be cut off by applying a negative voltage to the Whenelt electrode. In general to control the gun current output of large cathodes to the point of complete cut off an aperture grid or a mesh grid is used. An aperture grid as well as a mesh grid is much closer located to the cathode and is not used as a beam shaping electrode as in the case of the Whenelt.

Normally a grid is also electrically insulated from the first beam-forming electrode and cathode and a negative control voltage is usually applied to the grid. The Whenelt electrode of the gun described in this application is used to control the gun current output within a limited range. A wide range of current control is not important as the pulsed anode voltage dominates the behaviour of the transmitted current.

The gun of the present invention can easily be changed to a grided gun by simply fastening a mesh-grid made of suitable material to the Whenelt surface facing the cathode. This mesh-grid is thus electrically attached to the Whenelt and no other connections are required. This differs from conventional designs where the grid is not electrically connected to the Whenelt and requires a separate connection to the control voltage-supply. With a grid connected to the Whenelt it was found that the potential needed to control gun current is so low that no beam degradation takes place.

I claim:

1. A cathode assembly for mounting in an electron gun, comprising a metal support member having a first portion for securing the support member to a cathode assembly support within the gun and having a second portion which is generally cylindrical, a plurality of set screws spaced around the periphery of the second portion and extending radially through the thickness of the second portion, a split ring of solid insulating material having an outer diameter slightly less than the inner diameter of the first portion of the metal support member and being received within the first portion, a metal cylindrical holder having an outer diameter less than the inner diameter of the split ring and being received within the split ring to define with respect to the split ring a cylindrical space, a metal cathode tube carrying at its one end a cathode and heater and having at its other end a portion which is received snugly within the cylindrical space, the cathode tube having a bore through which extend heater leads, whereby axial alignment of the cathode can be adjusted by means of the set screws.

2. A cathode assembly according to claim 1 in which the split ring and second portion of the metal support member are so dimensioned that a clearance is provided therebetween when the set screws are tightened.

3. A cathode assembly according to claim 1 in which the split ring is made of a machinable ceramic.

4. A cathode assembly according to claim 1 in which the metal support member and the metal cylindrical holder are made of stainless steel.

5. A cathode assembly according to claim 1 in which the split ring is made of a machinable ceramic and the metal support member and the metal cylindrical holder are made of stainless steel.

6. A cathode assembly according to claim 1 in which the split ring is made of alumina and the metal support member and the metal cylindrical holder are made of stainless steel.

7. A cathode assembly according to claim 1 in which there are no more than four set screws.

8. A Whenelt electrode assembly for mounting in an electron gun, comprising a Whenelt electrode and a cylindrical metal housing having at one end means for securing the housing to a cathode assembly and having at the other end securing means for securing the Whenelt electrode across the bore of the housing, the securing means comprising a plurality of set screws spaced around the periphery of the housing and extending radially through the housing to engage complementary groove means in the periphery of the Whenelt electrode, the Whenelt electrode having an outer diameter less than the diameter of the housing bore whereby axial alignment of the Whenelt electrode can be adjusted by means of the set screws.

9. A Whenelt electrode assembly according to claim 8 in which the groove means is a continuous peripheral groove.

10. A Whenelt electrode assembly according to claim 8 in which there are no more than three set screws.

11. A Whenelt electrode assembly according to claim 8 in which the housing is stainless steel and has elongate through apertures.

12. A Whenelt electrode assembly according to claim 8 in which a heat shield for a cathode heater is mounted in the bore of the housing by means of a plurality of angularly spaced legs welded to the housing.

13. A Whenelt electrode assembly according to claim 12 in which there are no more than three spaced legs.

14. An anode assembly for mounting in an electron gun, comprising metal mounting means having a plurality of spaced parallel post portions attachable at a first end to a vacuum flange of the electron gun and having at a second end means for mounting an anode so as to extend in a transverse plane when the post portions, the means for mounting being arranged to hold the anode at a selected one of a plurality of different portions in the transverse plane whereby axial alignment of the anode can be adjusted.

15. An anode assembly according to claim 14 in which the means for mounting comprises screws threadably received in holes axially extending from the second end of the post portions and passing through oversized holes in an anode holder to which the anode is secured, the oversized holes permitting the adjustment of the lateral alignment, the screws having heads securing the anode holder at the selected position.

16. An anode assembly according to claim 15 in which the metal mounting means and the anode holder are made of stainless steel and the anode is made of molybdenum.

17. An anode assembly according to claim 15 in which the anode holder has a recess in which the anode is secured, the recess having a bottom surface on which are provided grooves for pumping away gasses produced between the anode and anode holder.

* * * * *

UNITED STATES PATENT AND TRADEMARK OFFICE

CERTIFICATE OF CORRECTION

PATENT NO. : 4,900,982

DATED : Feb. 13, 1990

INVENTOR(S) : Hans J. Kolpin

It is certified that error appears in the above-identified patent and that said Letters Patent is hereby corrected as shown below:

Title Page, Item [73], line 3, "Comitee" should be --Limitee--;
Column 4, line 66, "receiver" should be --received--;
Column 7, line 10, "when" should be --between--; and
Column 7, line 12, "portions" should be --positions--.

Signed and Sealed this

Fifteenth Day of October, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,900,982

DATED : Feb. 13, 1990

INVENTOR(S) : Hans J. Kolpin

It is certified that error appears in the above-identified patent and that said Letters Patent is hereby corrected as shown below:

Column 1, lines 54 and 56, and Column 6, lines 13 and 14, delete "first" and substitute -- second --.

Signed and Sealed this

Third Day of January, 1995

Bruce Lehman

*Attest:*

BRUCE LEHMAN

*Attesting Officer*

*Commissioner of Patents and Trademarks*